US008056571B2

(12) United States Patent
DeLacé

(10) Patent No.: US 8,056,571 B2
(45) Date of Patent: Nov. 15, 2011

(54) AXILLA AREA FORCE RECEIVER APPARATUS

(75) Inventor: Steven A. DeLacé, Santa Barbara, CA (US)

(73) Assignee: Propel Mobility, Santa Barbara, CA (US)

( * ) Notice: Subject to any disclaimer, the term of this patent is extended or adjusted under 35 U.S.C. 154(b) by 104 days.

(21) Appl. No.: 12/279,316

(22) PCT Filed: Feb. 13, 2007

(86) PCT No.: PCT/US2007/003713

§ 371 (c)(1), (2), (4) Date: Aug. 13, 2008

(87) PCT Pub. No.: WO2007/095195

PCT Pub. Date: Aug. 23, 2007

(65) Prior Publication Data

US 2009/0014043 A1 Jan. 15, 2009

Related U.S. Application Data

(60) Provisional application No. 60/772,936, filed on Feb. 13, 2006.

(51) Int. Cl.
*A61H 3/02* (2006.01)

(52) U.S. Cl. ..... 135/73; 135/68

(58) Field of Classification Search ..... 135/68, 135/73, 65, 66

See application file for complete search history.

(56) References Cited

U.S. PATENT DOCUMENTS

| | | | | |
|---|---|---|---|---|
| 1,376,380 | A * | 4/1921 | Pease | 135/73 |
| 2,408,604 | A | 10/1946 | Brickson | |
| 2,568,654 | A | 9/1951 | Neptune | |
| 2,736,330 | A | 2/1956 | Wood | |
| 2,741,255 | A | 4/1956 | Neptune | |
| 2,788,793 | A | 4/1957 | Abbott | |
| 3,133,551 | A | 5/1964 | Murcott | |
| 3,150,672 | A * | 9/1964 | Johnson, Jr. | 135/73 |
| 3,213,870 | A * | 10/1965 | Kiehn | 135/68 |
| 3,289,685 | A | 12/1966 | Parker | |
| D207,764 | S | 5/1967 | Lozo | |
| 3,492,999 | A | 2/1970 | Boyd | |
| 3,635,233 | A | 1/1972 | Robertson | |

(Continued)

FOREIGN PATENT DOCUMENTS

EP 0978268 B1 9/2000

(Continued)

OTHER PUBLICATIONS

Shortell, Dorota, MSME; Kucer, Jeff, MSME, Neeley, Lawrence W., BSME, LeBlance, MSME, CP, 'The Design of a Compliant Composite Crutch'; Journal of Rehabilitation Research and Development, vol. 38, No. 1, Jan./Feb. 2001; 12 pages.

(Continued)

*Primary Examiner* — David Dunn
*Assistant Examiner* — Danielle Jackson
(74) *Attorney, Agent, or Firm* — Mark Rodgers

(57) ABSTRACT

Aspects of the inventive technology include, in various embodiments, novel ambulation assistance apparatus with upper and lower force absorbers, perhaps with different displacement per force rates, novel crutches or canes that are convertable and/or foldable, and novel axilla area force receivers that may conform to part of a user's thorax, for use as part of a crutch.

1 Claim, 10 Drawing Sheets

U.S. PATENT DOCUMENTS

| | | | | |
|---|---|---|---|---|
| 3,730,198 | A | 5/1973 | Johnston et al. | |
| 3,768,495 | A | 10/1973 | Smith | |
| 3,886,962 | A | 6/1975 | Diamontis | |
| 4,184,503 | A | 1/1980 | Nakajima | |
| 4,196,742 | A | 4/1980 | Owen, Jr. | |
| 4,253,478 | A | 3/1981 | Husa | |
| 4,637,414 | A * | 1/1987 | Urban | 135/73 |
| 4,753,259 | A | 6/1988 | Hansen et al. | |
| 4,763,680 | A | 8/1988 | Acosta, Sr. | |
| 4,787,405 | A | 11/1988 | Karwoski | |
| 4,834,366 | A | 5/1989 | Hotchkiss | |
| 4,869,280 | A | 9/1989 | Ewing | |
| 5,193,567 | A | 3/1993 | Razny, Jr. | |
| 5,318,058 | A | 6/1994 | Zimmerman | |
| 5,335,683 | A | 8/1994 | Ledley | |
| 5,402,811 | A | 4/1995 | Weng | |
| 5,458,143 | A | 10/1995 | Herr | |
| 5,458,145 | A | 10/1995 | Davis | |
| 5,482,070 | A | 1/1996 | Kelly | |
| 5,495,867 | A | 3/1996 | Block | |
| 5,628,335 | A | 5/1997 | Free | |
| 5,725,005 | A | 3/1998 | Yamasaki et al. | |
| 5,752,535 | A | 5/1998 | Sanders | |
| 5,901,724 | A | 5/1999 | Andrea et al. | |
| 6,055,998 | A | 5/2000 | Bader | |
| 6,085,766 | A | 7/2000 | Geary | |
| 6,253,776 | B1 | 7/2001 | Lin | |
| 6,286,529 | B1 | 9/2001 | Olivera | |
| 7,104,271 | B2 | 9/2006 | Larson et al. | |
| 2002/0144723 | A1 | 10/2002 | Zulla et al. | |
| 2003/0106576 | A1 * | 6/2003 | Tunnell et al. | 135/68 |
| 2004/0025926 | A1 | 2/2004 | Gin et al. | |
| 2006/0118154 | A1 | 6/2006 | David | |
| 2006/0185703 | A1 | 8/2006 | Townsend et al. | |
| 2008/0035190 | A1 * | 2/2008 | Baker | 135/68 |

FOREIGN PATENT DOCUMENTS

| | | | |
|---|---|---|---|
| EP | 0738837 | B1 | 4/2002 |
| FR | 2641169 | | 7/1990 |
| JP | 07328083 | A | 12/1995 |
| JP | 08275977 | A | 10/1996 |
| JP | 2000126253 | A | 5/2000 |
| WO | 20041012641 | A2 | 2/2004 |

OTHER PUBLICATIONS

Scanion, Jessie, 'A Leg up for Crutch Design', http://www.businessweek.com, Aug. 31, 2006.

U.S. Appl. No. 60/772,936, filed Feb. 13, 2006, entitled "Melinda S-flex curve crutch versions A, B & C".

International Application No. PCT/US07/03713; Search Report mailed Aug. 25, 2008.

International Application No. PCT/US07/03713; Written Opinion of the International Searching Authority mailed Aug. 25, 2008.

* cited by examiner

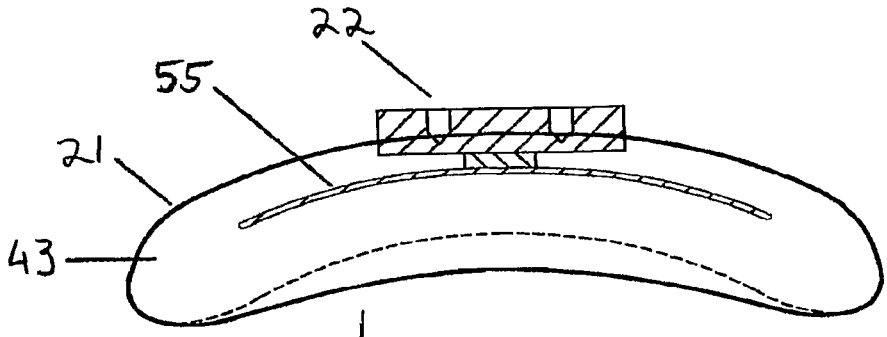
Fig. 6A
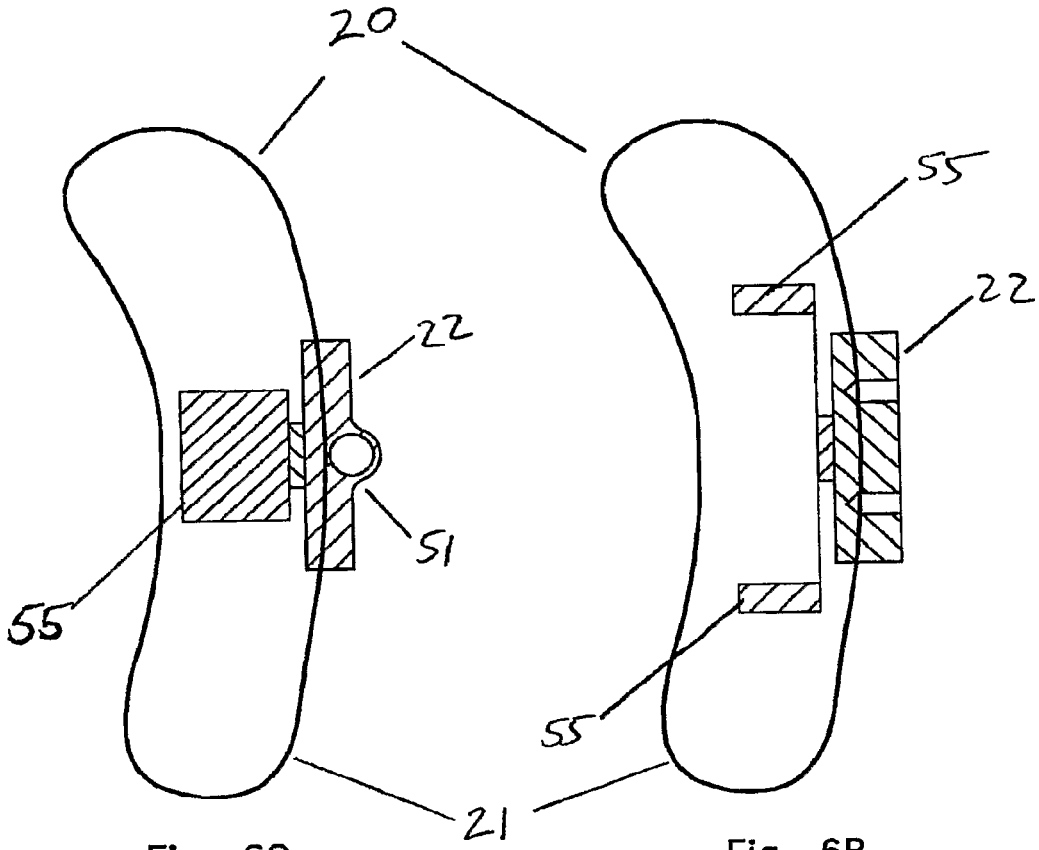
Fig. 6C
Fig. 6B

AXILLA AREA FORCE RECEIVER APPARATUS

This is an international patent application claiming priority to and the benefit of U.S. provisional application 60/772,936, filed 13 Feb., 2006, said provisional application incorporated herein by reference.

TECHNICAL FIELD

Generally, the inventive technology disclosed herein relates to novel ambulation assistance apparatus such as crutches and canes. More specifically, varying aspects of the inventive technology include novel ambulation assistance apparatus with upper and lower force absorbers, novel crutches or canes that are convertable and/or foldable, and novel axilla area force receivers that may conform to part of a user's thorax, for use as part of a crutch.

BACKGROUND ART

Ambulation assistance apparatus such as crutches, walkers and canes have been in use for many years. Some estimate the origin of the crutch at over 5,000 years ago. However, even with such time to evolve from their more primitive origins, today's ambulation assistance apparatus leave much to be desired. Conventional designs—including but not limited to the standard "tuning fork" design crutch and the Canadian forearm crutch—are often uncomfortable, user-unfriendly, and at times painful. With its focus on ergonomics and performance, particular embodiments of the inventive technology disclosed herein seek to alleviate at least some of these drawbacks.

In 2006, there were estimated to be 32.2 million users of ambulation assistance apparatus (such as crutches, walkers and canes) in the United States. Approximately 24.4 million temporary users enter the market annually due to short term injury or illness. Permanent and long-term users number over 7.8 million. The total annual market cap exceeds 1.80 billion US dollars. Due to the aging 'baby-boomer' generation, the need of orthopedic walking aids is forecasted to grow significantly over the next 10 years. The world market of walking aid consumers currently exceeds 80 million. Whether used by amputees, paraplegics, injured persons, the elderly, disabled or others, there is a need for ambulation assistance apparatus, and a desire for an improved design.

Conventional crutch designs are not limited to the "tuning fork", as there have been many attempts in the last century to modify the design of the standard axillary crutch, including the development of Canadian crutches, a combination of axillary crutches and elbow crutches. Additional designs include vertical spring-loaded crutches and rocker-bottom crutches. Even with such effort devoted to improving designs, there is still a need for a crutch, in particular, with a greater focus on ergonomics, comfort, and performance. Especially given that walking with a crutch requires approximately twice as much energy as expended by a fully able-bodied person walking without a crutch, there is a need for a higher performing, more ergonomic crutch that is less physically demanding.

Particular embodiments of the inventive technology focus on improving ambulation assistance apparatus performance by addressing one or more of the following needs: weight support, durability, shock receipt and energy return, 'lightweightedness', maneuverability, comfort, reduction of pain and stress on body characteristic of conventional designs, facilitative of user multi-taking, enhancing of self-esteem, and quietness. In doing so, it is hoped that individuals will be more likely to use the improved crutch than remain immobile or rely on wheeled transport. As such, it is hoped that the improved ambulation assistance apparatus disclosed and claimed herein will result in one or more of the following: improved bone growth, reduced bladder infection, improved blood circulation, ease of mobility, reduced pressure sores and prevention/reduction of contractures. Of course, other advantages of the inventive technology may appear elsewhere in the specification.

DISCLOSURE OF INVENTION

The inventive technology relates to novel ambulation assistance apparatus and methods. Particular embodiments may improve the operational performance of crutches by providing new force absorption and return configurations, by providing a crutch with a support that may conform to the side of the thorax, and/or by providing a crutch with improved folding, adjustability and/or conversion-to-cane capabilities.

BRIEF DESCRIPTION OF DRAWINGS

FIG. 6A shows a top, cross-sectional view of an embodiment of the inventive axilla area force receiver technology.

FIG. 6B shows a side cross-sectional view of an embodiment of the axilla area force receiver, where the force receiver has only one leaf spring.

FIG. 6C shows a side cross-sectional view of an embodiment of the axilla area force receiver, where the force receiver has two leaf springs.

MODE(S) FOR CARRYING OUT THE INVENTIVE TECHNOLOGY

Figure 1:
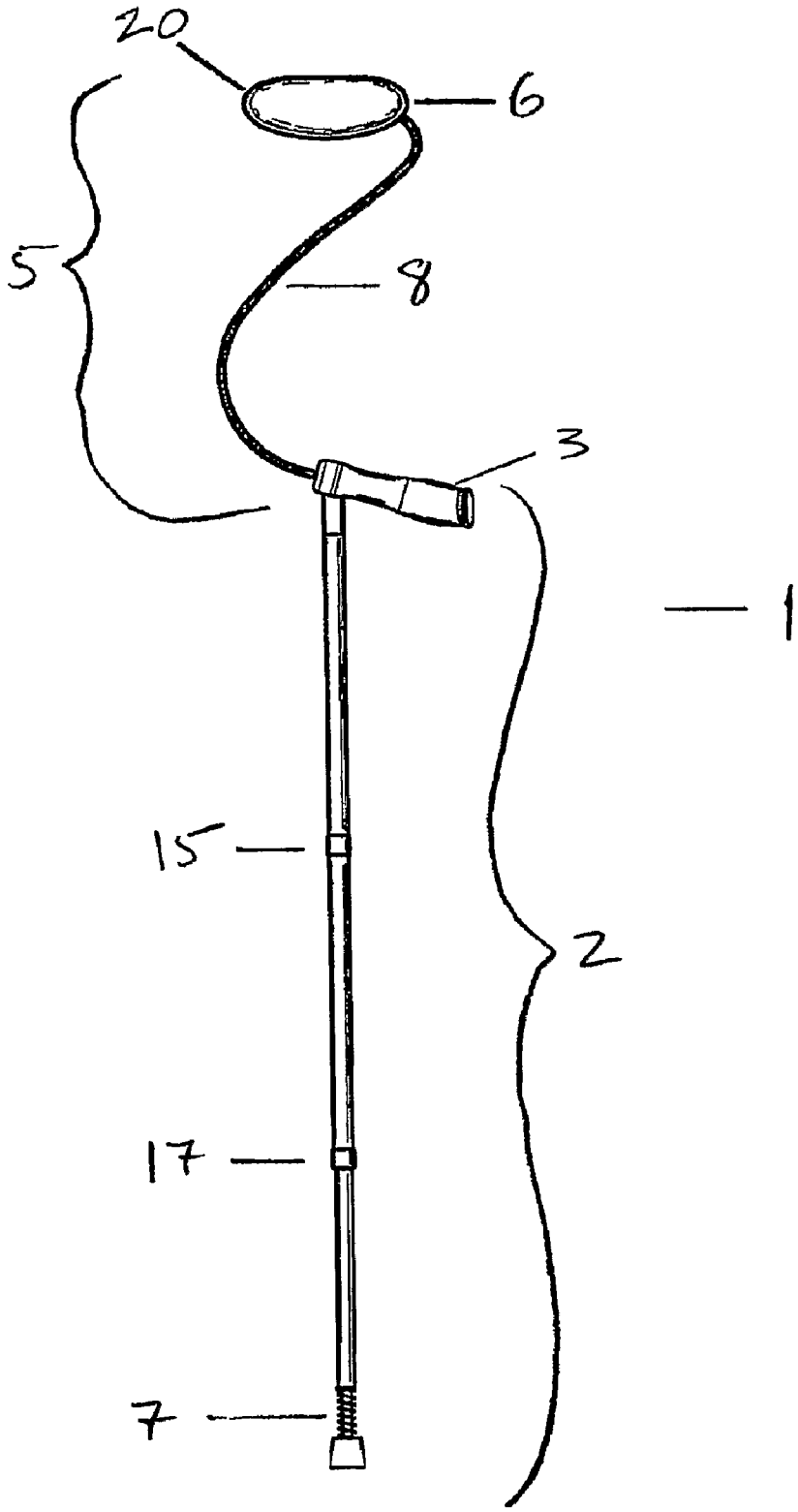
FIG. 1 shows a side view of an embodiment of the inventive technology in crutch mode, as may be seen by a user thereof.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments.

The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

At least one embodiment of the inventive technology is an ambulation assistance apparatus 1 (e.g., crutches or cane) that comprises a lower structural portion 2 that includes a hand grip 3 that receives a hand force from a user 4 during use of the apparatus, an upper structural portion 5 established above the lower structural portion and including an axillary support 6 that receives an axilla area force from the user during the use of the apparatus, a lower force absorber 7 (e.g., a coil spring) established as part of the lower structural portion and configured to absorb the hand force; and an upper force absorber 8 (e.g., S curve shaped bar) established as part of the upper structural portion and configured to absorb only the axilla area force. In preferred embodiments, the lower force absorber absorbs the hand force at a first displacement per force rate and the upper force absorber absorbs the axilla area force at a second displacement per force rate that is greater than the first displacement per force rate. Exemplary displacement per force rates include but are not limited to: first displacement per force rate of from 1/100 inches per pound force to 1/20 inches per pound force; and a second displacement per force rate of from 1/20 to 1/2 inches per pound force.

The term axilla area force is not limited to that force applied at the armpit 9, as the term area implies in the general region of the armpit, including the axilla (armpit) itself, and that lower part of the arm (including that part that substantially abuts the armpit) 10 (the triceps brachii may act in these areas), and also that area below the armpit 11, including the left and right sides of the outside of the thoracic cage (the latissimus dorsi and possibly also the serratus anterior may act in these areas). Indeed, the axilla area may include the outside of the thoracic cage substantially below the armpit from immediately below the armpit to as much as seven inches below the armpit. At times, the lower force absorber 7 may absorb a portion of this axilla area force, as it may be transmitted down to the lower structural portion even though it, or a portion of it, may be absorbed. It is of note that either force absorber may be adjustable. Whether adjustable or not, either spring (a broad term, not limited to coil springs, leaf springs, or S curve shaped springs) may provide energy return upon elastic return to its unloaded configuration, thereby improving efficiency of gait, and reducing stress/strain on the user.

Figure 5:
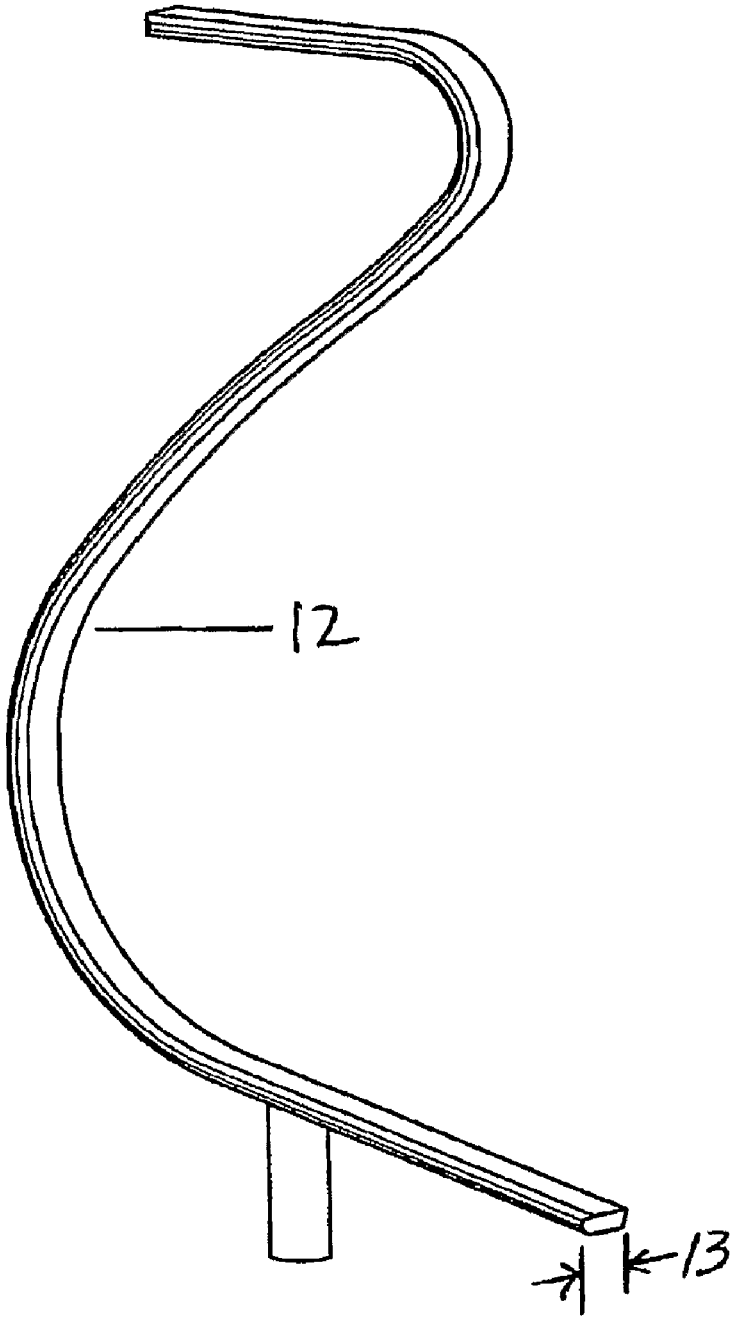
FIG. 5 shows a perspective view of the S curve shaped force absorber as may appear in at least one embodiment of the inventive technology.
Figure 7:
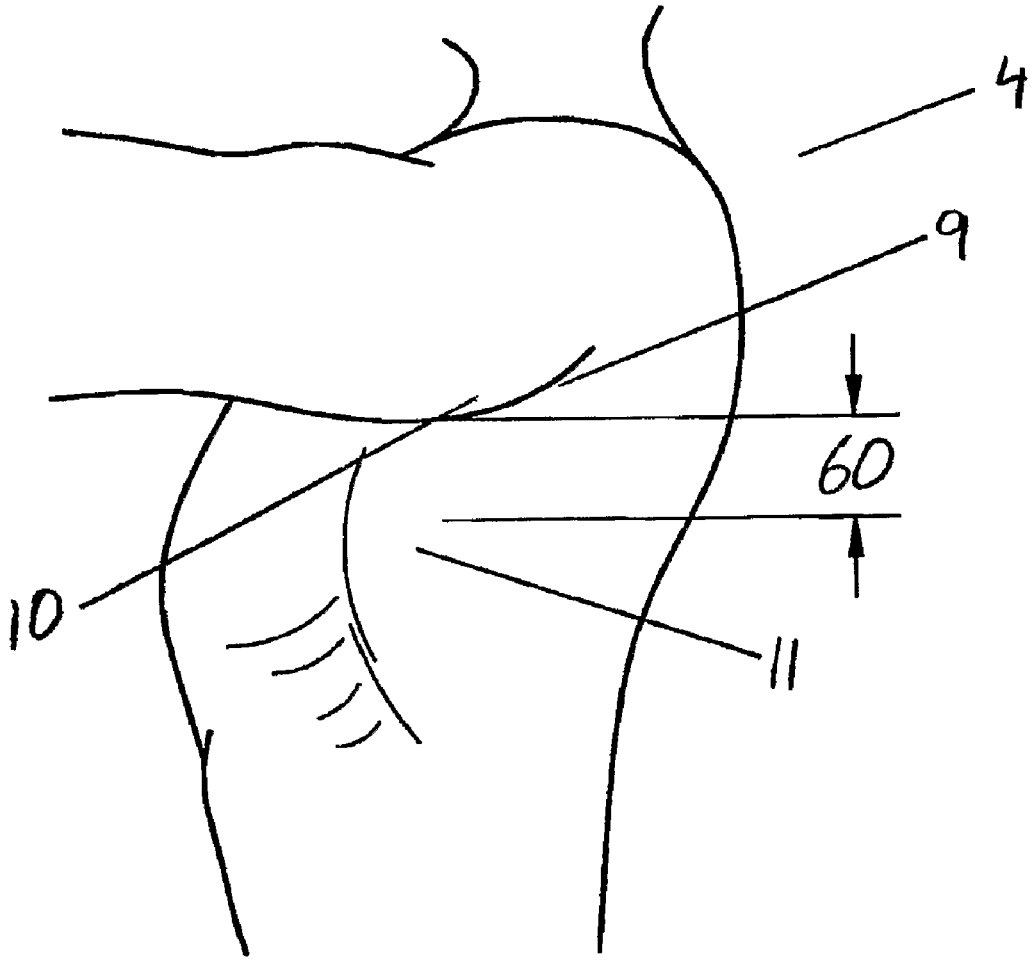
FIG. 7 shows a crutch user with arm extended to show at least a portion of the axilla area.

In certain embodiments, an ambulation assistance apparatus may comprise a lower structural portion 2 that includes a hand grip 3 that receives a hand force from a user during use of the apparatus; an upper structural portion 5 established above the lower structural portion 2 and including an axillary support 6 that receives an axilla area force from the user during the use of the apparatus; an upper force absorber 8 established as part of the upper structural portion and configured to absorb the axilla area force, where the upper force absorber comprises a S curve shaped bar 12 that flexes in response to the axilla area force. In particularly relevant regard, it is of note that such curved bar is, in preferred embodiments and during use of the crutch, curved in and flexible substantially a plane that is parallel a sagittal plane of the user (see, e.g., FIG. 5). As used herein, such plane may have a horizontal depth 13 that is substantially equal to the width of the S curve shaped bar. It is also of note that, in particular embodiments, the S curve shaped bar may comprise a carbon fiber S curve shaped bar, and is established entirely above the hand grip. Further, the lower force absorber of preferred embodiments is a coil spring 14 instead of a S curve shaped bar and is established as part of the lower structural portion.

Particular embodiments of the inventive technology focus more on the convertible and/or foldable capabilities of embodiments of the apparatus. In relevant regard, an ambulation assistance apparatus may comprise a lower structural portion 2 that includes a hand grip 3 that receives a hand force from a user during use of the apparatus; an upper structural portion 5 established above the lower structural portion and including an axillary support 6 that receives an axilla area force from the user during the use of the apparatus; a joint 15 such as a hinge established as part of the lower structural portion and enabling manual reconfiguration of the ambulation assistance apparatus from operation mode to storage mode; and a fastener 16 (e.g., a threaded fastener) that allows removal of the upper structural portion from at least part of the lower structural portion. The fastener 16, in particular, may enable conversion of the apparatus from a crutch to a cane, while the joint 15 may enable folding of the crutch (or cane) for ease of transport or storage.

Figure 2:
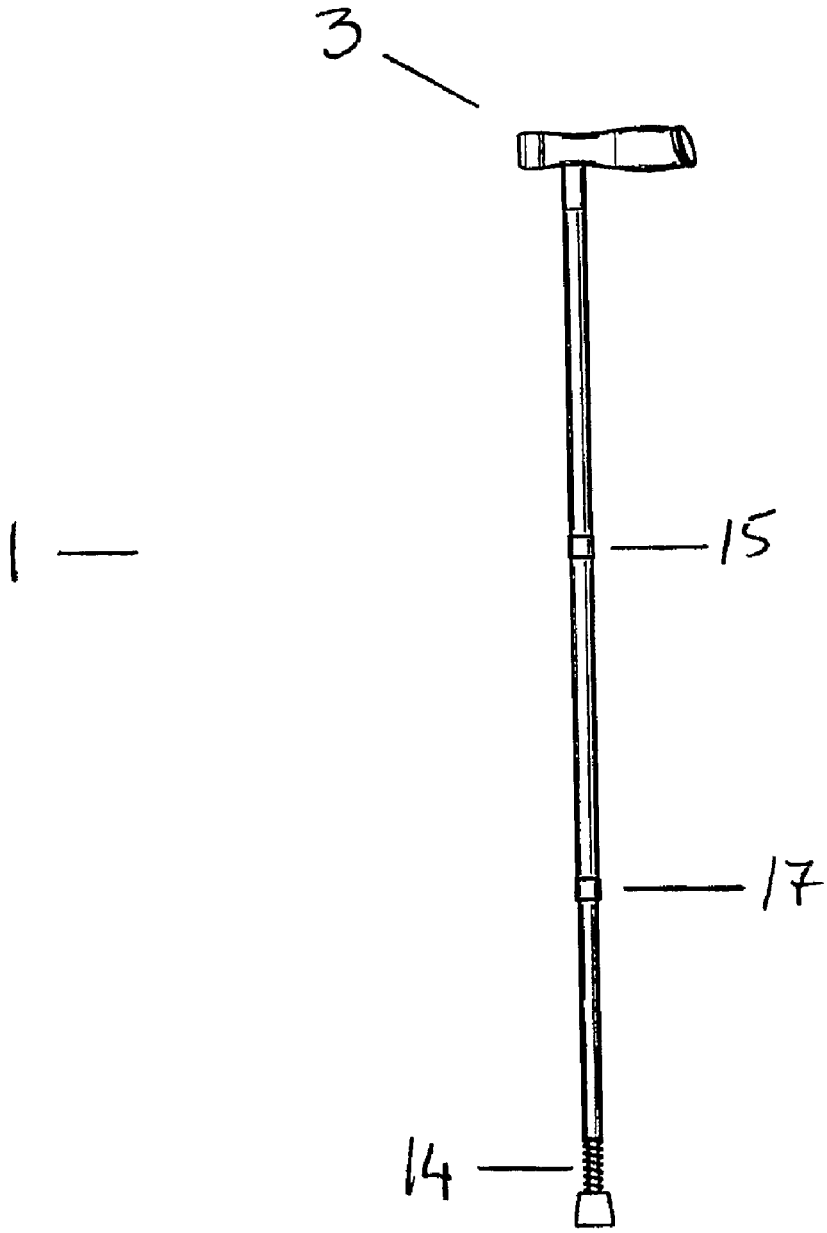
FIG. 2 shows a side view of an embodiment of the inventive technology in cane mode.
Figure 3:
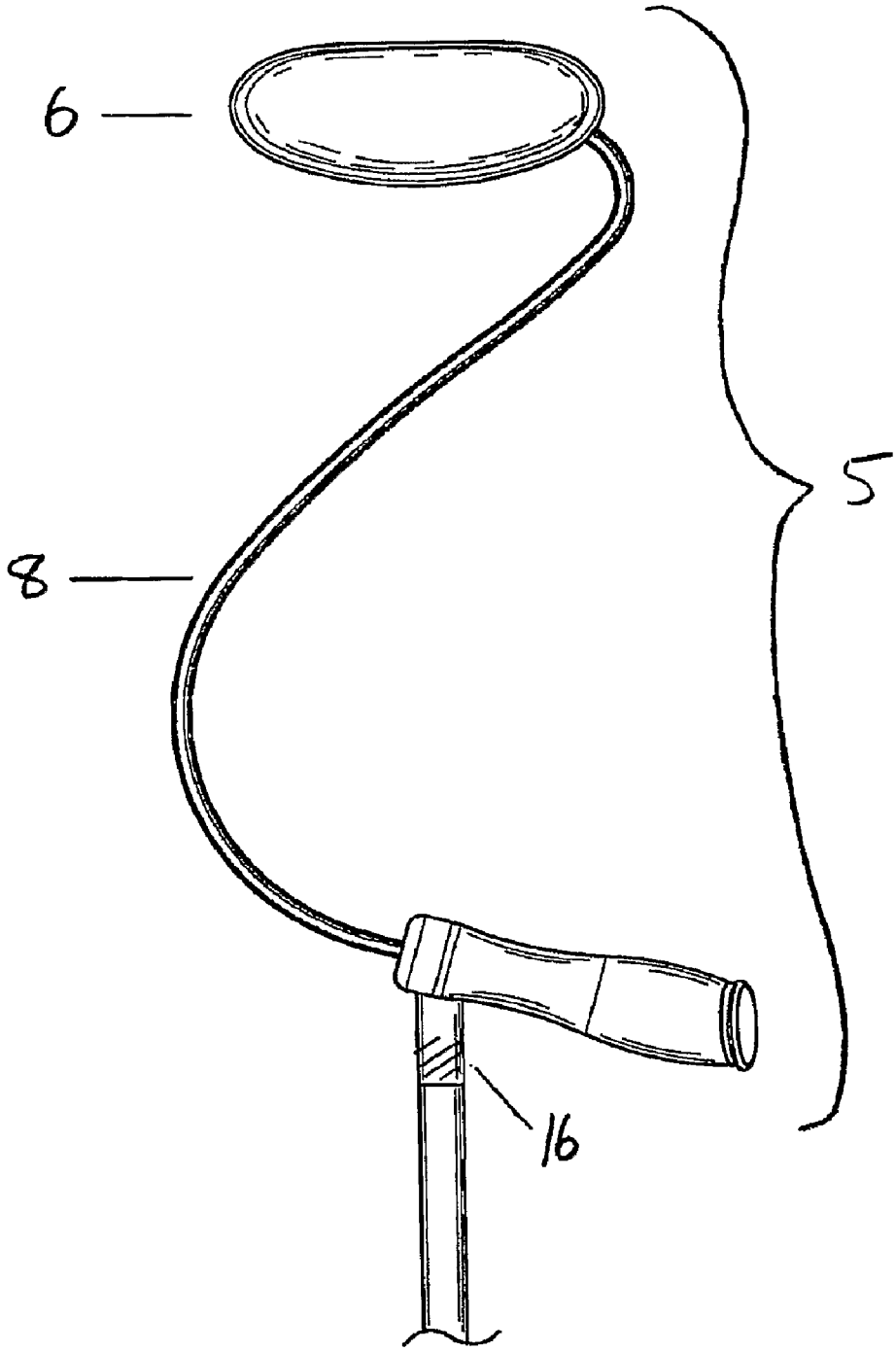
FIG. 3 shows a side view of a portion of an embodiment of the inventive technology in crutch mode.
Figure 4:
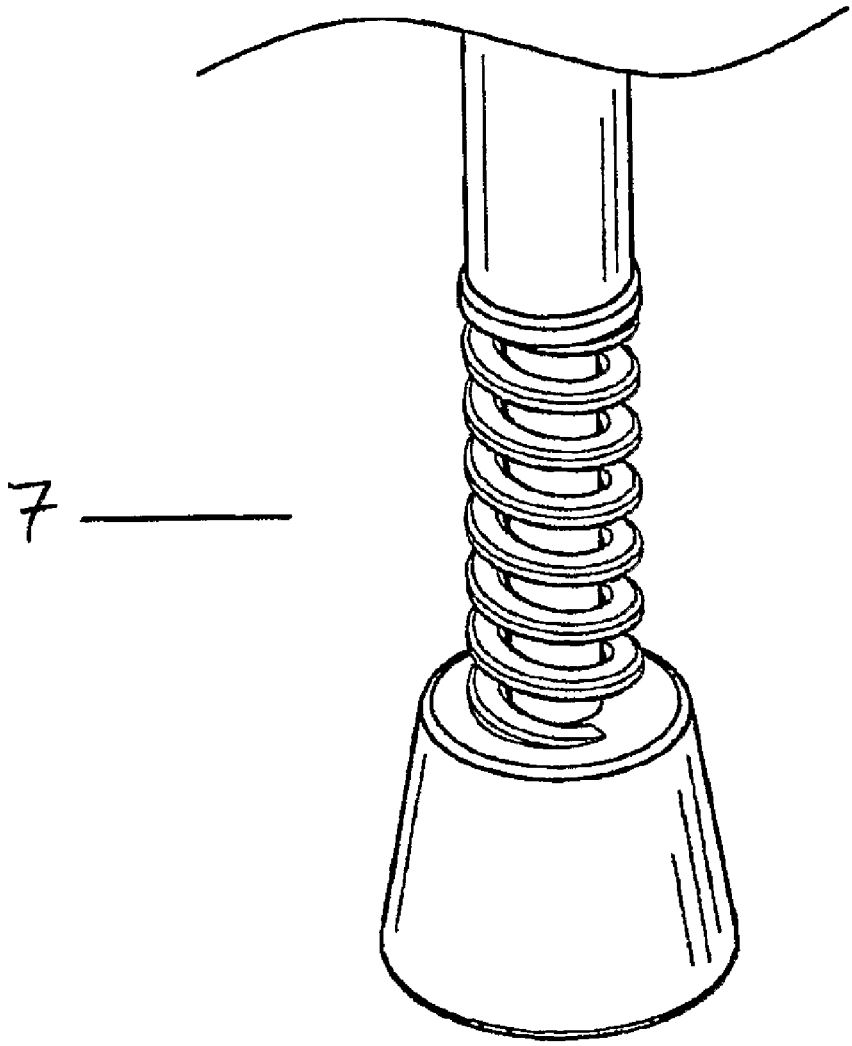
FIG. 4 shows the bottom end of embodiments of the ambulation assistance apparatus in either crutch or cane mode.

It is of note that in preferred embodiments, at least a portion of the lower structural portion is removable from the upper structural portion, thereby enabling conversion of the apparatus from a crutch to a cane. This may be accomplished upon removal of the hand grip from the lower portion (by unscrewing it, e.g.), thereby also removing the upper force absorber and other componentry attached (directly or indirectly) thereto. In a preferred embodiment, the reconfiguration of the apparatus into a cane may be completed upon screwing on a different hand grip, perhaps one angled at 90 degrees relative to a vertical axis (for the cane, during operation, as shown in FIG. 2) as opposed to a 75 degree axis (for the crutch, during its operation, as shown in FIG. 1). In such embodiments, the lower structural portion may be characterized as consisting of a hand grip and a lower structural portion remainder. The fastener may be established so as to allow removal of the hand grip from the lower structural portion remainder. Additionally, the hand grip may be deemed a first hand grip (crutch configuration), and the apparatus may further comprise a second hand grip that is attachable to the lower structural portion remainder to form the cane. In such embodiments, and as shown in FIG. 1, the first hand grip may attach to the lower structural portion remainder at angle other than 90 degrees from vertical (e.g., 75 degrees from vertical).

It is also of note that the lower force absorber 7 may be adjustable (e.g., its spring constant may be altered). Other adjustment capabilities include length adjustment of the apparatus (in either crutch or cane mode) via, for example, a length adjuster 17 such as a well-known telescoping device. Another reconfiguration capability includes foldability of the apparatus; in embodiments offering such capability, a joint 15 (e.g., a hinge) may be provided to enable folding of the apparatus for ease of either storage or transportation.

Particular embodiments may focus on an axilla area force receiver apparatus 20 comprising: a force receiver body 21; and a force receiver body attacher 22 enabling attachment (perhaps pivotal attachment, perhaps not) of the force receiver body to an upper part of a crutch, wherein, when the force receiver body is attached to the crutch and the crutch is established in an operational configuration by a user of the crutch, the force receiver body has a three dimensional user proximate surface 30 that has a thoracic cage proximate portion 31 and an axilla proximate portion 32. Further, in particular embodiments, the thoracic cage proximate portion has a horizontal cross-sectional profile 40 that is curved when undeformed, and the axilla proximate portion has a vertical cross-sectional profile 41 that is curved when undeformed. In particular embodiments, the force receiver body may include cushioning material 43. Indeed, the force receiver itself may provide some force absorption. It is also of note that, as explained above, the term axilla area force is intended to include not only forces applied from the axilla itself, but indeed forces applied from the axilla area as described herein.

Figure 8A:
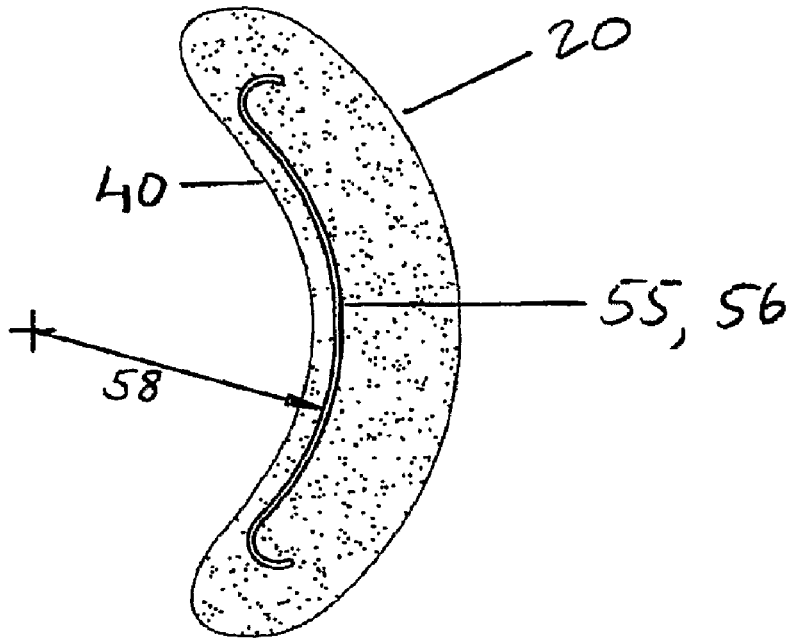
FIG. 8A shows a top view of a cross-section of an embodiment of the axilla area force receiver apparatus in undeformed configuration.
Figure 8B:
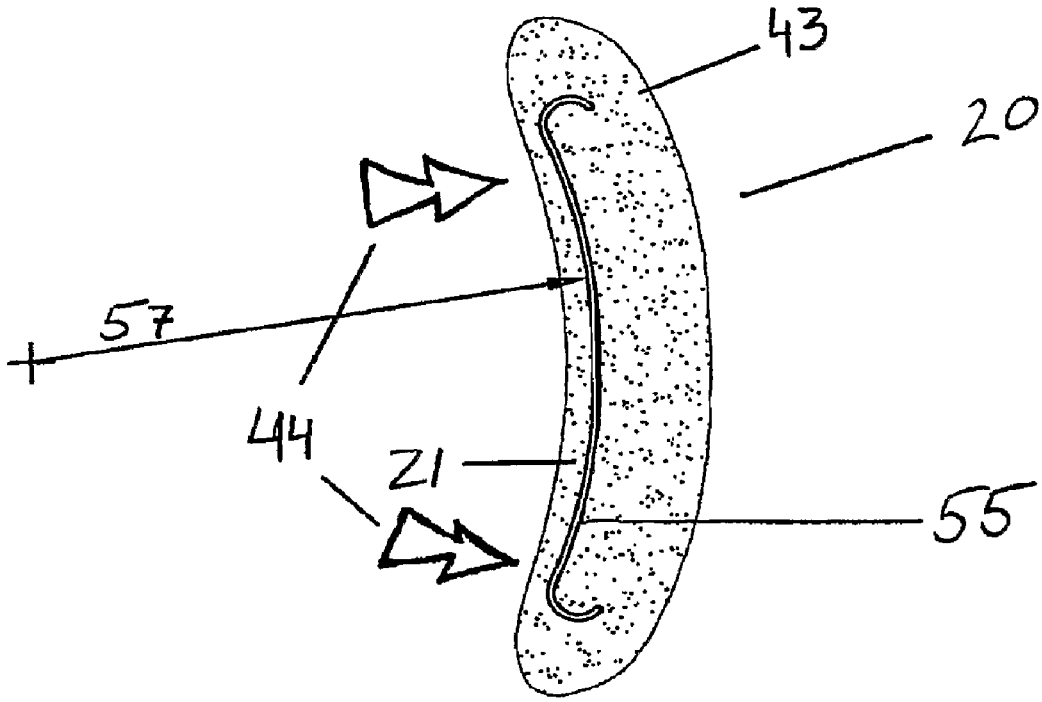
FIG. 8B shows a top view of a cross-section of an embodiment of the axilla area force receiver in deformed configuration after receiving a force from a side of the thorax of a user.

In particular embodiments, when the force receiver body is attached to the crutch and the crutch is established in an operational configuration by the user, the force receiver body is deformable upon application of a horizontal force applied from part of the upper thoracic cage of the user. Upon application of the horizontal force 44 (whether it be a component of an angled force or not), the force receiver body may conform to the outside of the part of the upper thoracic cage of the user (see FIG. 8B). Further, in some embodiments, when the force receiver body 21 is attached to the crutch and the crutch is established in an operational configuration by the user, the force receiver body is deformable upon application of a vertical force 45 applied from part of the axilla area of the user.

Figure 9:
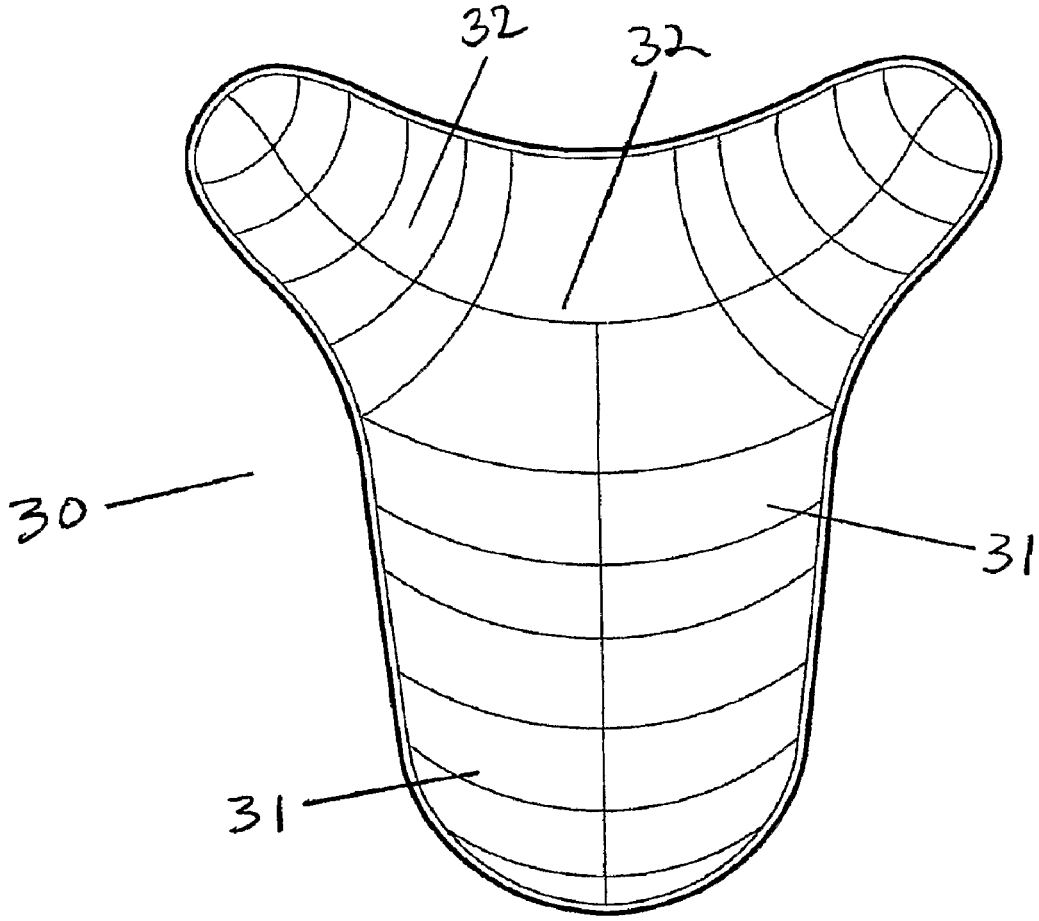
FIG. 9 shows an upper perspective view, as might be seen by a crutch user, of an embodiment of the crutch having an axilla area force receiver having a user-proximate surface of canted hyperbolic paraboloidal shape.
Figure 10:
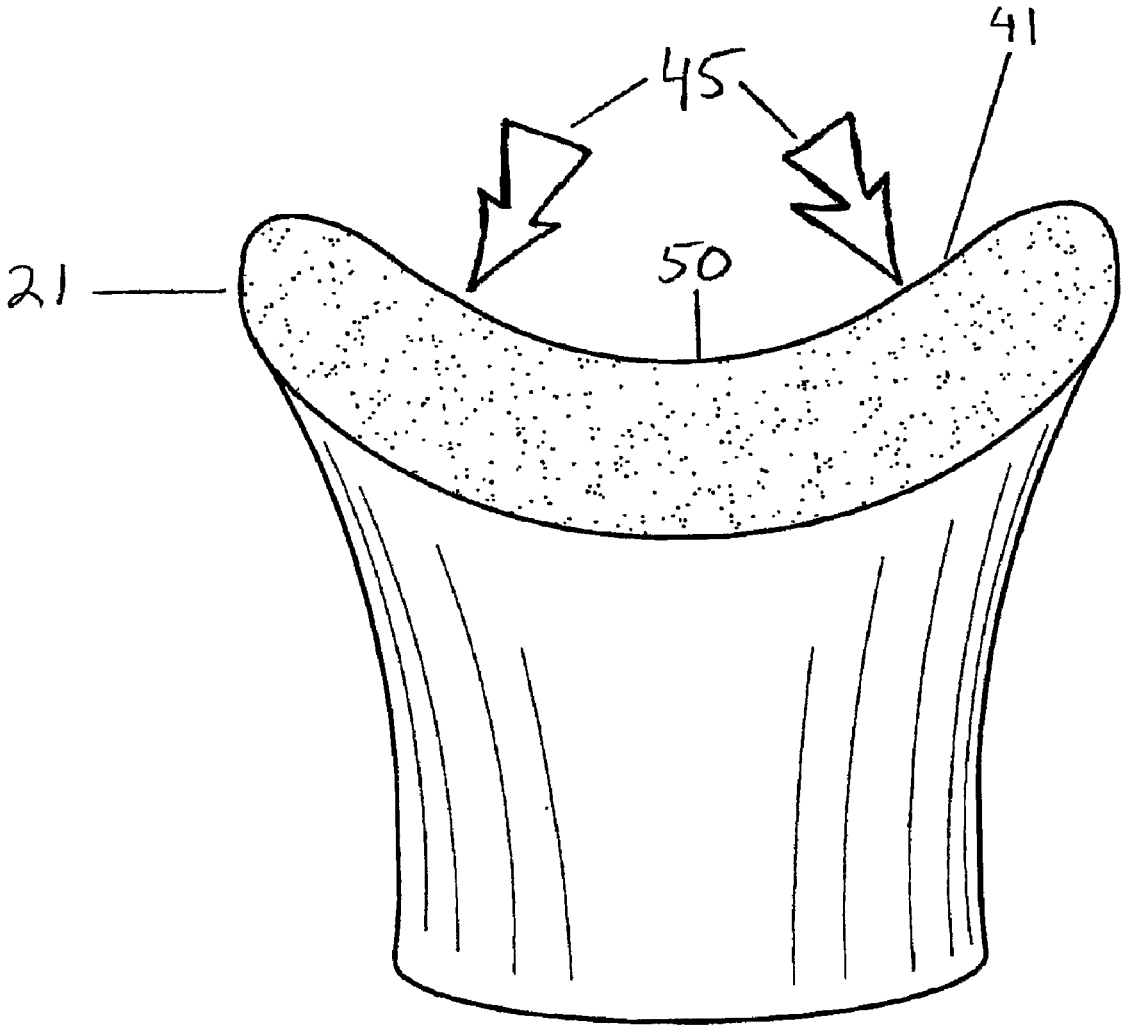
FIG. 10 shows a side view of a force receiver body in vertical cross-section, as might be seen by a person to the side of a crutch in operational.

In particular embodiments, the three dimensional user proximate surface approximates a hyperbolic paraboloid; as shown in FIG. 9, such hyperbolic paraboloid may be canted towards the user of the crutch (e.g., tilted such that it is not oriented substantially vertically (a mounted horse saddle is considered mounted substantially vertically)). In preferred embodiments (but not necessarily all embodiments), when the force receiver body is attached to the crutch and the crutch is established in an operational configuration by a user of the crutch on level terrain, the axilla proximate portion 32 of the force receiver body's surface has a center portion 50 that is substantially three inches 60 below an axilla of the user (in other embodiments, 1 inch, 2 inches, 4 inches, and 5 inches). As certain designs may be retrofittable to existing crutches (or portions thereof), the force receiver body attacher 22 may be configured to allow retrofitting of the axilla area force receiver apparatus onto at least part of a conventional crutch. Additionally, particular embodiments may include a pivoter 51 that enables pivoting of the force receiver body about a horizontal axis. As explained more fully below, such pivoter may, but need not, allow for pivoting of the axilla area force receiver body from one side of the crutch to the other, rendering a unitary crutch universal in the sense that it can be used as either a right or a left crutch. Such a "fully pivoting" design may be necessary in order to render a crutch universal in those embodiments where the axilla area force receiver apparatus is unique for either side of the user's body (e.g., one is designated left and one right).

Particular aspects of the inventive technology may focus on different aspects of an axilla area force receiver apparatus. Such apparatus may comprise: a force receiver body 21; and a force receiver body attacher 22 enabling attachment of the force receiver body to an upper part of a crutch, wherein, when the force receiver body is attached to the crutch and the crutch is established in an operational configuration by a user of the crutch, the force receiver body has a three dimensional user proximate surface 30 that has a thoracic cage proximate portion 31 and an axilla proximate portion 32. Such apparatus may further comprise a spring 55 (e.g., a leaf spring) established so that the spring acts in a horizontal plane and enables return of the thoracic cage proximate portion from a user conforming configuration (see FIG. 8B) to a biased or unconformed configuration (see FIG. 8A) upon disapplication of a horizontal force 44 applied by the user. Instead, or additionally, the tension of the spring may allow the force receiver body to "hug" the thoracic cage. The spring (again, including but not limited to a leaf spring 56, such as a metal leaf spring) may be established substantially in a horizontal plane, perhaps in cushioning material 43. Such cushioning material (or other material making up the force receiver body) may be "swollen" at the top (see, e.g., FIGS. 6B and 6C). Additionally, in particular embodiments, the thoracic cage proximate portion may define a first radius of curvature 57 when in a user conforming configuration and the leaf spring, when in the biased configuration, may be configured to define a second radius of curvature 58 that is less than the first radius of curvature. It is of note that if such portions are non-circular, then the radius of curvature would be an average radius of curvature. Additionally, it is of note that in preferred embodiments, the horizontal force is applied from part of a thoracic cage of the user. As in certain other aspects of the inventive technology, the force receiver body attacher 22 may allow retrofitting of the axilla area force receiver apparatus onto at least part of a conventional crutch. As mentioned, embodiments may further comprise a pivoter 51 that enables pivoting of the force receiver body about a horizontal axis.

It is also of note that during use of the apparatus, ideally the top of the center 50 of the force receiver body is below the lower part of the arm (e.g., approximately 3" below bottom of the arm). Indeed, preferred use of the inventive crutch during use in normal, flat conditions may initially require adjusting the crutch (e.g., with a force receiver body attacher that enables height adjustment of the force receiver body, and/or with a length adjuster 17) so that such sizing constraints are met. However, at times, whether because of poor form, an improper adjustment, travel up or down stairs, ramps or inclined surfaces, the lower part of the arm (in the area of the armpit) may indeed contact the force receiver body. At such times, the force applied thereto may be significantly greater than that observed where only the side of the thoracic cage contacts the force receiver body.

Features of the inventive technology may include, but are not limited to: two methods for shock receiver and return; adjustable shock absorbers at bottom of crutch; foldability for ease of storage and transportation; length adjustability; convertability from crutch mode to cane mode and visa versa, allowing dual functional use; lightweight, perhaps through use of carbon-fiber composites, aluminum, titanium, composite alloys; ergonomically designed axillary pads and handle grips.

Particularly in those embodiments of the inventive technology having two force absorbers, each with a different displacement per force rate, novel methods may relate to vertically displacing, during use of a crutch, the uppermost part of a crutch (e.g., the axilla area force receiver) such that the displacement is a superimposition of an upper displacement resulting from an upper force absorber having a second displacement per force rate and a lower displacement from a lower force absorber having a first displacement per force rate that is different from the second displacement per force rate. Instead, or additionally, the inventive technology may involve the application of an axilla area force to an upper axilla area force receiver of a crutch without applying a force from the axilla (the armpit itself) directly. As the reader has perhaps gleaned, such may be accomplished by an axilla area force receiver that "hugs" the outside of a side of the thoracic cage of a user.

It is also of note that the structural design and componentry described herein would be well within the ken of the ordinary artisan in the relevant field. Of course, typically two crutches are used by a user (although not always). In relevant regard, it is of note that each crutch may, but need not, be side specific (e.g., each crutch may be either only a right side crutch or only a left side crutch), as indeed the force receiving apparatus may be adapted for use with either side by a universal shape and/or the force receiving apparatus may be pivotable entirely from one side of the crutch to the other side, rendering such crutch "universal." Of course, such pivot capability (that, e.g., allows pivoting about a horizontal axis) may be easily provided at the receiver body attacher by providing such attacher with a pivoter 51. It is further of note that the crutch may be designed so that each unitary crutch is universal, regardless of whether there is pivot capability; such may involve merely shaping the axilla area force receiver apparatus so that it fits under each arm.

As can be easily understood from the foregoing, the basic concepts of the present invention may be embodied in a variety of ways. It involves both ambulation assistance techniques as well as devices to accomplish the appropriate ambulation assistance. In this application, the ambulation assistance techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "force absorber" should be understood to encompass disclosure of the act of "force absorbing"—whether explicitly discussed or not—and, conversely, were there effectively disclosure of the act of "force absorbing", such a disclosure should be understood to encompass disclosure of a "force absorber" and even a "means for force absorbing" Such changes and alternative terms are to be understood to be explicitly included in the description.

Any acts of law, statutes, regulations, or rules mentioned in this application for patent; or patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

I. U.S. PATENT DOCUMENTS

| DOCUMENT NO. & KIND CODE (if known) | PUB'N DATE mm-dd-yyyy | PATENTEE OR APPLICANT NAME |
|---|---|---|
| U.S. Pat. No. 2,788,793 | Apr. 16, 1957 | Abbott |
| U.S. Pat. No. 3,492,999 | Feb. 3, 1970 | Boyd |
| U.S. Pat. No. 4,184,503 | Jan. 22, 1980 | Nakajima |
| U.S. Pat. No. 3,886,962 | Jun. 3, 1975 | Diamontis |
| U.S. Pat. No. 3,635,233 | Jan. 18, 1972 | Robertson |
| U.S. Pat. No. 4,253,478 | Mar. 3, 1981 | Husa |
| U.S. Pat. No. 5,482,070 | Jan. 9, 1996 | Kelly |
| U.S. Pat. No. 5,402,811 | Apr. 4, 1995 | Weng |

-continued

I. U.S. PATENT DOCUMENTS

| DOCUMENT NO. & KIND CODE (if known) | PUB'N DATE mm-dd-yyyy | PATENTEE OR APPLICANT NAME |
|---|---|---|
| U.S. Pat. No. 4,869,280 | Sep. 26, 1989 | Ewing |
| U.S. Pat. No. 4,787,405 | Nov. 29, 1988 | Karwoski |
| U.S. Pat. No. 6,286,529 B1 | Oct. 22, 1998 | Olivera |
| U.S. Pat. No. 6,085,766 | Jul. 11, 2000 | Geary |
| U.S. Pat. No. 7,104,271 B2 | Apr. 14, 2005 | Larson et al. |
| US 2002/0144723 A1 | Oct. 10, 2002 | Zulla et al. |
| US 2006/0118154 A1 | Jun. 8, 2006 | David |
| US 2006/0185703 A1 | Aug. 24, 2006 | Townsend et al. |
| US 2004/0025926 A1 | Feb. 12, 2004 | Gin et al. |
| U.S. Pat. No. 6,253,766 B1 | Jul. 3, 2001 | Lin |
| U.S. Pat. No. 6,055,998 | May 2, 2000 | Bader |
| U.S. Pat. No. 5,901,724 | May 11, 1999 | Andrea et al. |
| U.S. Pat. No. 5,752,535 | May 19, 1998 | Sanders |
| U.S. Pat. No. 5,628,335 | May 13, 1997 | Free |
| U.S. Pat. No. 5,458,145 | Oct. 17, 1995 | Davis |
| U.S. Pat. No. 5,458,143 | Oct. 17, 1995 | Herr |
| U.S. Pat. No. 5,335,683 | Aug. 9, 1994 | Ledley |
| U.S. Pat. No. 5,318,058 | Jun. 7, 1994 | Zimmerman |
| U.S. Pat. No. 5,193,567 | Mar. 16, 1993 | Razny, Jr. |
| U.S. Pat. No. 4,753,259 | Jun. 28, 1998 | Hansen et al. |
| U.S. Pat. No. 4,196,742 | Apr. 8, 1980 | Owen, Jr. |
| U.S. Pat. No. 3,730,198 | May 1, 1973 | Johnston, et al. |
| U.S. Pat. No. 3,133,551 | May 19, 1964 | Murcott |
| D 207,764 | May 23, 1967 | Lozo |
| U.S. Pat. No. 2,736,330 | Feb. 28, 1956 | Wood |
| U.S. Pat. No. 3,768,495 | Oct. 30, 1973 | Smith |
| U.S. Pat. No. 3,289,685 | Dec. 6, 1966 | Parker |
| U.S. Pat. No. 5,495,867 | Mar. 5, 1996 | Block |
| U.S. Pat. No. 2,568,654 | Sep. 18, 1951 | Neptune |
| U.S. Pat. No. 4,763,680 | Aug. 16, 1988 | Acosta, Sr. |
| U.S. Pat. No. 2,741,255 | Apr. 10, 1956 | Neptune |

II. FOREIGN PATENT DOCUMENTS

| Foreign Patent Document Country Code, Number, Kind Code (if known) | PUB'N DATE mm-dd-yyyy | PATENTEE OR APPLICANT NAME |
|---|---|---|
| PCT/US03/24923 | | |
| EP 0 978 268 B1 | Sep. 2, 2000 | Rehberger |
| WO 2004/012641 A3 | Jan. 12, 2004 | Hessa |
| EP 0 738 837 B1 | Apr. 12, 2002 | Sugiyama |
| JP 08275977 A | Oct. 22, 1996 | Takashige |
| JP 2000126253 A | May 9, 2000 | Junich et al. |
| JP 07328083 A | Dec. 19, 1995 | Shinichi |

III. NON-PATENT LITERATURE DOCUMENTS

Shortell, Dorota, MSME; Kucer, Jeff, MSME, Neeley, Lawrence W., BSME, LeBlance, MSME, CP, 'The Design of a Compliant Composite Crutch'; Journal of Rehabilitation Research and Development, Vol. 38 No. 1. January/February 2001; 12 pages.
Scanion, Jessie, 'A Leg up for Crutch Design', http://www.businessweek.com. Aug. 31, 2006.

Thus, the applicant(s) should be understood to have support to claim and make a statement of invention to at least: i) each of the ambulation assistance devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A crutch pad for contacting a thoracic curve portion of a user's thoracic cage, wherein the thoracic curve portion is that part of the thoracic cage lying below the armpit and on the side of the body between the back and stomach, comprising;

a curved foam compliant pad with an inner radius and an internal spring embedded in the curved foam pad curved to follow the curved foam pad curvature, wherein the inner radius of the curved foam pad when pressed against the thoracic curve portion to bias the spring is shaped to fit the thoracic curve portion; and, a crutch mount configured to place the curved foam pad with the inner radius of the curved foam pad curve facing the thoracic curve portion when the curved foam pad is installed on a crutch and the crutch is in use, wherein;

a restoring force of the spring and curved foam pad when biased against the side of the body provides weight bearing support from the side.

* * * * *